US005090178A

United States Patent [19]

Ricchio

[11] Patent Number: 5,090,178

[45] Date of Patent: Feb. 25, 1992

[54] METHOD OF ASSEMBLY FOR SIMPLIFIED CONTAINER

[75] Inventor: Danny T. Ricchio, Racine, Wis.

[73] Assignee: S. C. Johnson & Son, Inc., Racine, Wis.

[21] Appl. No.: 620,963

[22] Filed: Jan. 7, 1991

Related U.S. Application Data

[62] Division of Ser. No. 502,152, Mar. 29, 1990.

[51] Int. Cl.[5] ..... B65B 5/06

[52] U.S. Cl. ..... 53/456; 53/156; 53/243; 53/489; 493/92

[58] Field of Search ..... 53/456, 485, 487, 486, 53/489, 491, 443, 458, 452, 471, 158, 156, 144, 169, 539, 243; 493/102, 89, 92, 94, 84

[56] References Cited

U.S. PATENT DOCUMENTS

| | | | |
|---|---|---|---|
| 1,016,436 | 2/1912 | Palmer et al. | 53/144 X |
| 2,102,508 | 12/1937 | Brooks | 53/156 X |
| 3,134,308 | 5/1964 | Ali-Oglu | 493/92 |
| 4,907,397 | 3/1990 | Goodman | 53/156 X |

*Primary Examiner*—James F. Coan

[57] ABSTRACT

A two-part container assembly made up of a cover and a filler insert, both of which are assembled from precut unitary blanks. The filler insert has a bottom section and two end flaps. Articles to be packaged are placed upon the bottom of the filler insert, optionally first into a separate tray. Then the cover is placed over the filler insert and the assembly inverted and then fastened together. A method of forming and assembling is also disclosed.

2 Claims, 3 Drawing Sheets

METHOD OF ASSEMBLY FOR SIMPLIFIED CONTAINER

This is a division of co-pending application Ser. No. 07/502,152 filed on Mar. 29, 1990.

TECHNICAL FIELD

This invention relates to the field of containers for the shipping and storage of articles and more particularly, to a simplified two-part container assembly having a top cover and a bottom filler insert. After the article or articles to be contained are placed on the filler insert, the cover is placed over the insert and the assembly inverted and then sealed with tape. A display or holding to hold the articles tray may be placed upon the filler insert, and the article or articles placed in the tray before assembly and sealing of the container.

BACKGROUND ART

Since many articles are packaged and shipped in containers, most often containers made of corrugated material, there are many known configurations and methods for assembling such containers. Most such container assemblies are intended to be used for the shipping and storage of manufactured products (although various types of containers for fruits and vegetables are also known). Many such containers form a display tray for the products, or as well as being useable for shipping and storage. Thus important considerations are economy of material use, ease of assembly and filling, and compactness.

U.S. Pat. No. 3,767,109 to Paige, "Box Cover and Combination Cover and Box", claims, inter alia, a box cover for use with a box having a bottom wall, two opposed side walls, two opposed end walls, and two flaps wherein one flap extends inwardly over each of the end walls. The cover has two hingedly attached end portions which are adapted to be received between the box flaps and the side walls adjacent thereto.

U.S. Pat. No. 3,955,671 to Ockey, "Shipping and Display Carton", claims a carton for shipping and displaying comprising an open top carton member and a second carton member configured to fit over the open top of the first carton in telescopic relation wherein one of the cartons has a tab means and the other carton has a slot means.

U.S. Pat. No. 4,784,271 to Wosaba, II, et al., "Tear Strip Openable Shipping/Display Container with Butt Joint discloses a container, formable from a single blank, that has a circumferential tear strip. When the tear strip is pulled off, the assembled container separates into a base and a top.

U.S. Pat. No. 4,471,870 to Uhlig, "Package for Holding a Plurality of Discrete Container Assemblies", discloses a two-part container assembly having a tray member with an encircling rim and a unitary cover shroud having a handle means. A plurality of containers interconnected by a carrier, rest in the tray and the top cover shroud is placed over them and secured.

SUMMARY DISCLOSURE OF THE INVENTION

The present invention is a simplified two-part container assembly for the shipping and storage of articles comprising a filler insert and a cover. Both the filler insert and the cover are formed from unitary precut blanks having fold lines thereupon, the blanks being preferably formed of corrugated material. The filler insert has a base and two upstanding flaps. The assembled cover has the general shape of an open-ended box. A tray, designed to hold a plurality of articles and to be placed upon the base of the filler insert may be utilized. The container assembly, once the articles to be contained have been placed onto the filler insert and the cover placed over the filler insert in such a way that the flaps of the filler insert project upwardly within the cover, may be secured by taping or other fastening means. The height of the cover and the height of the articles to be contained are correlated so that minimal free head space exists within the container assembly. The method of assembling, filling, and sealing the container assembly is also disclosed.

The present invention thus offers a simplified, compact container assembly. The cover and filler insert are assembled from a minimum of material. The compact fit between the articles contained and the dimensions of the container means that no waste space exists inside the container assembly and thus more articles can be stored or shipped within a given volume of space on a shelf or in a transport vehicle than would be the case with less space efficient containers. The simplicity of the container assembly, having a minimum of fold lines and areas needing attachment, also means that the labor required to assemble, fill, and seal the containers is minimized.

When the tray is to be removed from the carton, it is only necessary to cut the tape between each end of the filler insert and the side walls of the cover. Due to the structure of the cover side walls and the upwardly extending ends of the filler insert, neither the tray nor the contained articles will be subject to being cut. Thereafter, the cover is simply lifted upward and the tray and articles therein are ready to be displayed.

BEST MODE FOR CARRYING OUT THE INVENTION

Figure 1:
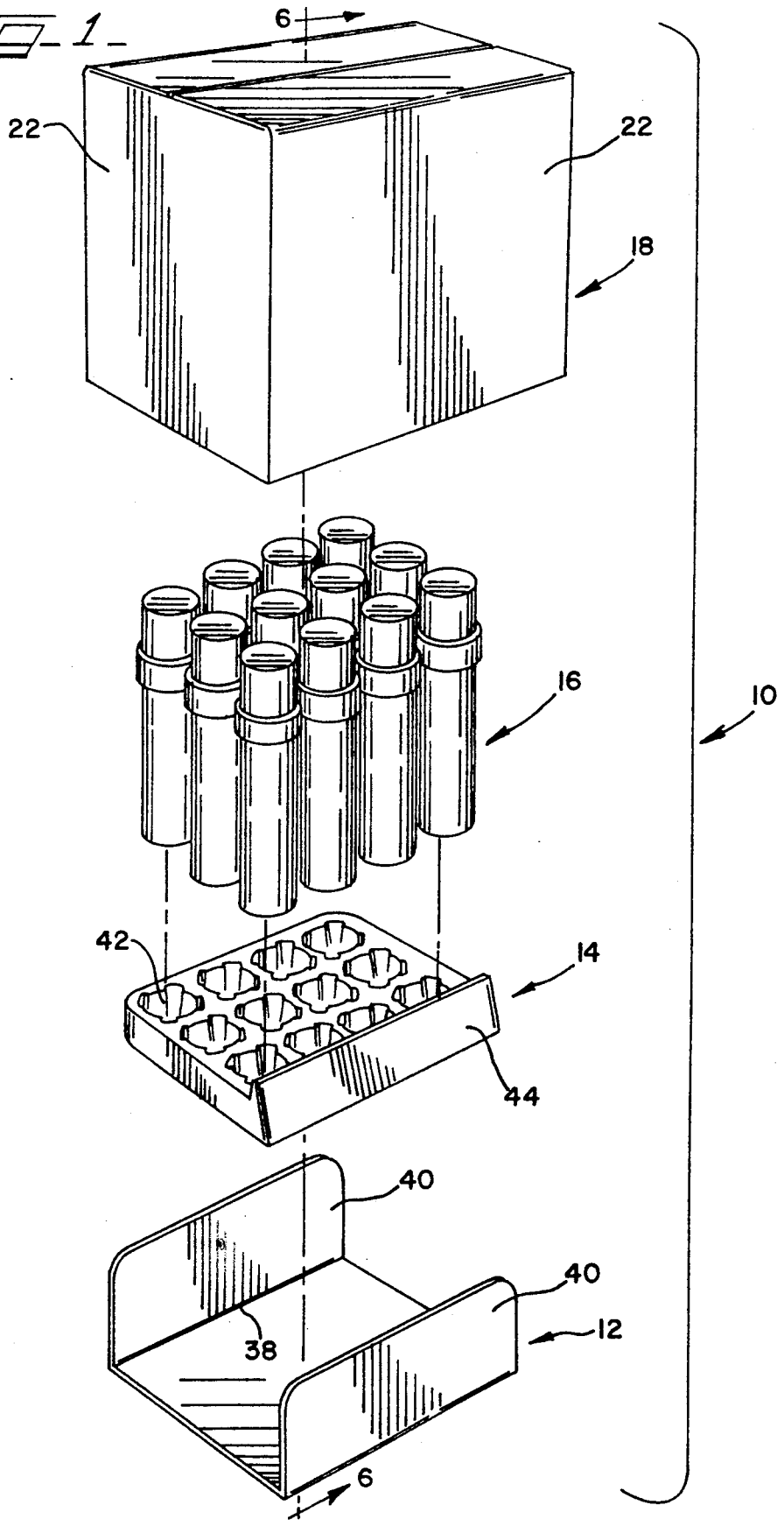
FIG. 1 is an exploded perspective view of the container assembly, showing the filler insert, the tray, an array of articles to be inserted into the tray, and the cover.
Figures 2, 3, 4:
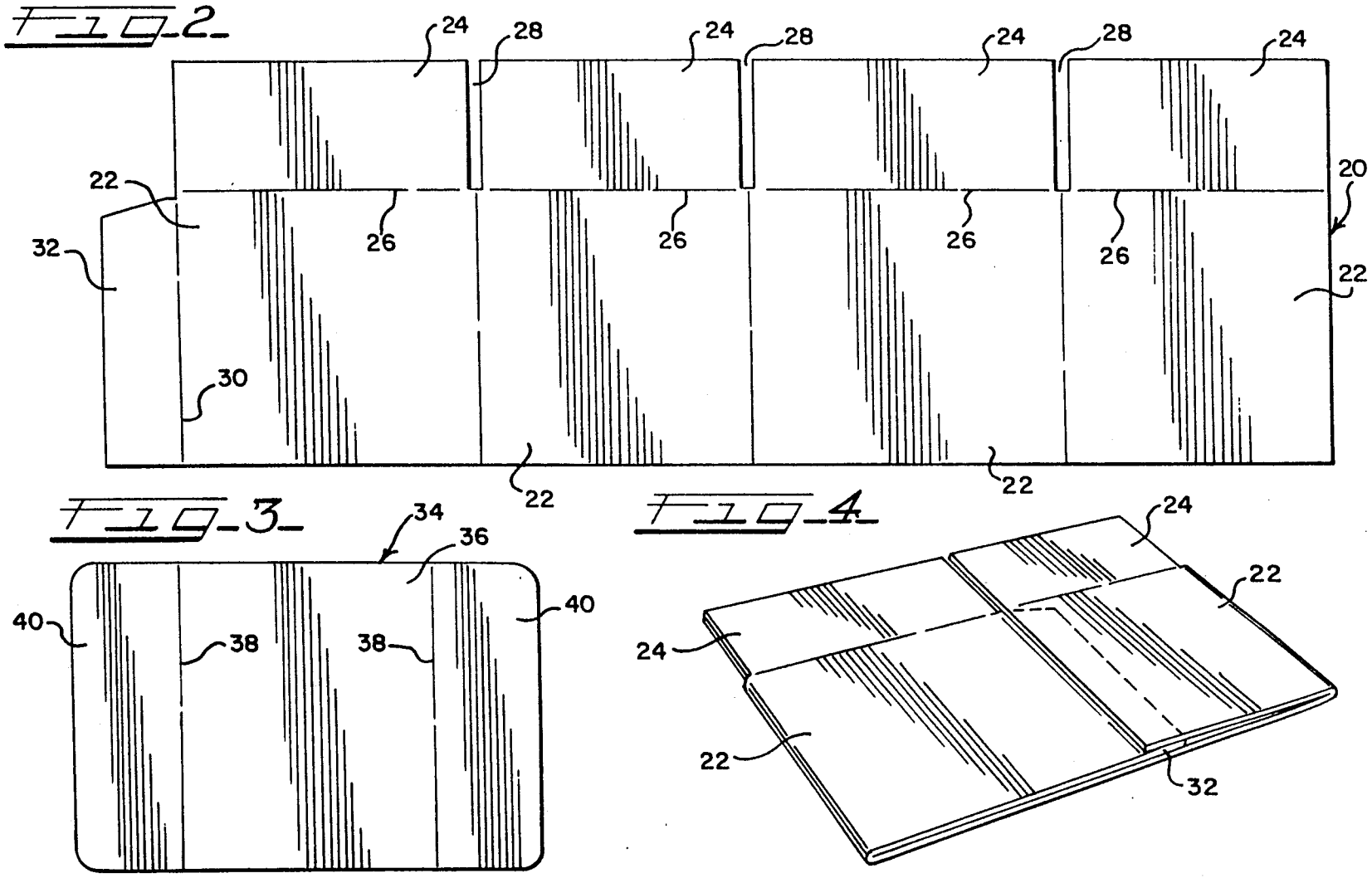
FIG. 2 is a plan view of the blank from which the cover of the container assembly is assembled.
FIG. 3 is a plan view of the blank from which the filler insert of the container assembly is assembled.
FIG. 4 is a perspective view of the cover of the container in a partially assembled position.

FIG. 1 shows an exploded perspective view of the container assembly, generally indicated as 10. Container assembly 10 comprises filler insert 12, tray 14, articles 16 for shipment and storage within container assembly 10 and cover 18. Cover 18 and filler insert 12 are preferably formed from corrugated material. Cover 18 is assembled from cover blank 20 which is shown in FIG. 2. Cover blank 18 has four sidewall forming sections 22. Each side forming section 22 integrally formed therewith and extending upwardly along one edge thereof, a top forming flap 24. Each top forming flap 24 is separated from its adjoining sidewall forming section 22 by top forming flap fold line 26 and separated from its adjacent top forming flap 24 by top flap slot 28 (which is, in the manufacture of cover blank 20, formed by half-slotting the cover blank).

Integrally formed with but separated from by attachment flap fold line 30 is attachment flap 32, which extends outwardly from one end sidewall forming section 22.

FIG. 3 shows filler insert forming blank 34. Filler insert forming blank 34 has a filler base section 36 and, integrally formed therewith but separated therefrom along opposite edges of filler base section 36 by filler flap fold lines 38, a pair of filler flap forming sections 40.

FIG. 4 shows a perspective view of cover 18 in a partially assembled position. Attachment flap 32 has been overlapped with and fastened to, preferably with gluing means (although other fastening means such as stapling or taping are possible) one edge of the sidewall forming section 22 located at the opposite end of cover blank 20 from attachment flap. This half-assembled configuration is the one in which a manufacturer of the cover and filler inserts of the container assembly would most conveniently ship the cover to a packager for use. The filler insert would most conveniently be shipped in the flat form shown in FIG. 3.

Figure 5:
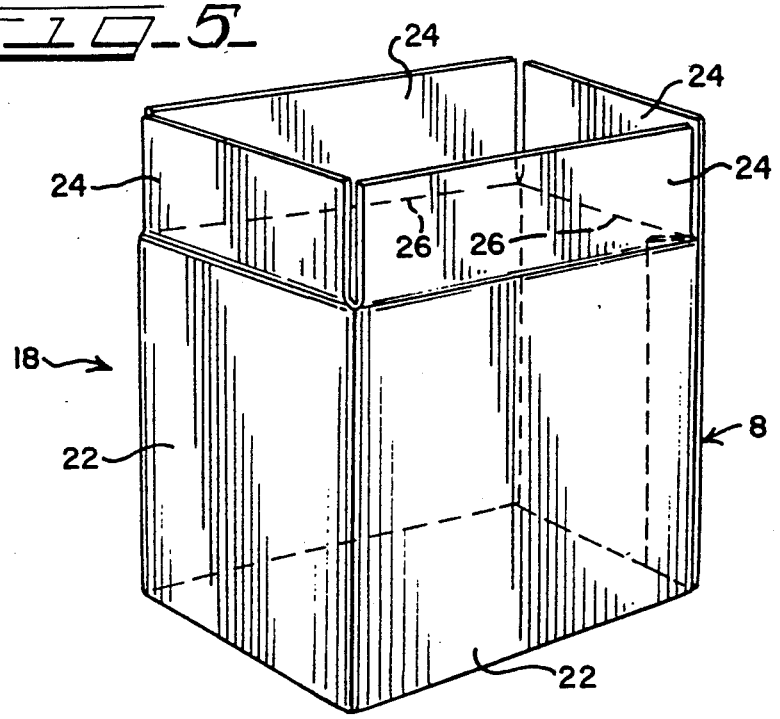
FIG. 5 is a perspective view of the cover in a second partially assembled position in which the configuration shown in FIG. 4 has been opened out.

FIG. 5 shows cover 18 in a second partially assembled position. In this position, the fastened cover forming blank configuration shown in FIG. 4 has been set upright and opened out. To complete assembly of cover 18, top forming flaps 24 are bent downward and inward along top forming flap fold line 26, two oppositely located ones at a time.

The outer, exposed pair of top forming flaps 24 are then cleaned by any conventional fastening means, such as taping or gluing.

Filler insert 12 is formed from filler insert forming blank 34 by bending filler flap forming sections 40 upwardly along filler flap fold lines 38, as can be seen in FIG. 1.

Tray 14 is shown in FIG. 1. Tray 14 is formed somewhat like an open ended box structure with one or more tray recesses 42 located on the top surface of the box structure into which articles or products to be shipped and stored can be placed. An array of such articles is depicted as 16 in FIG. 1. Obviously, the number of tray recesses 42 within tray 14 will vary with the number of articles to be accommodated. Tray 14 is preferably made of thermoformed plastic and preferably has, running along one side, an enlarged flat display or label accepting area 44.

Figure 6:
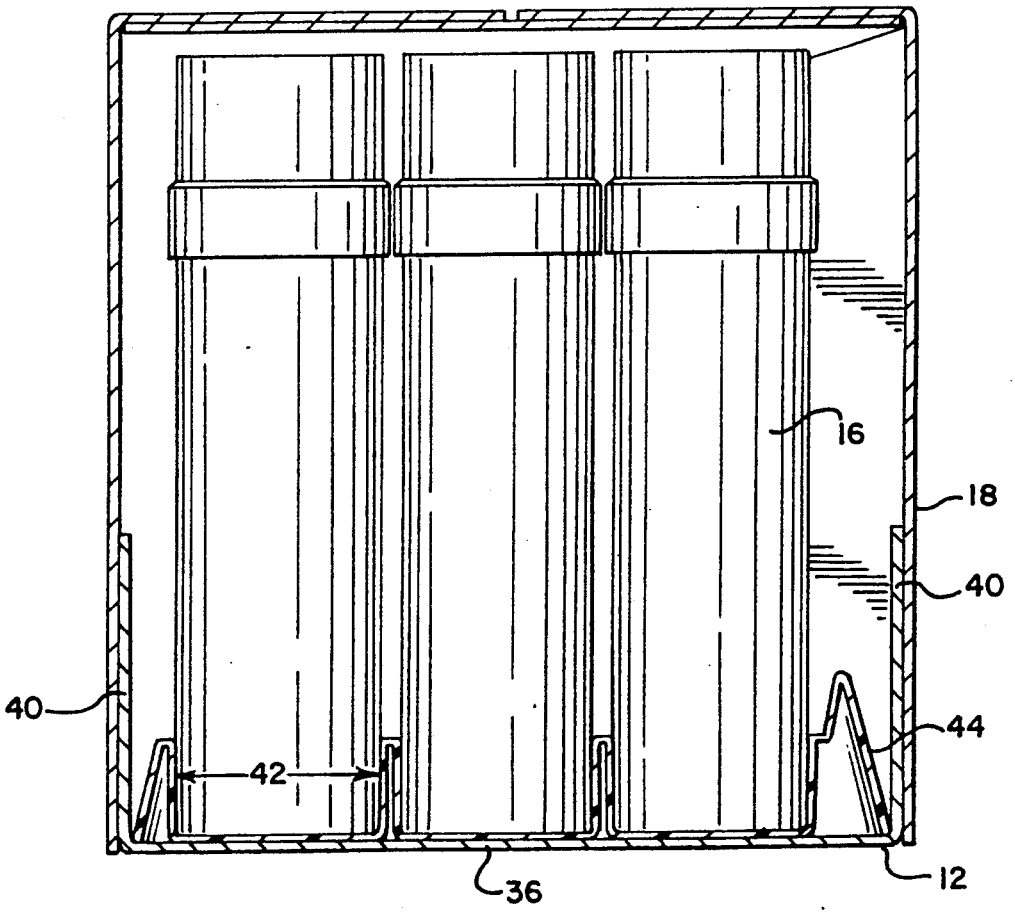
FIG. 6 is a side sectional view of the assembled container, taken along line 6—6 indicated on FIG. 1, showing the manner in which the parts shown in FIG. 1 are fitted together.

FIG. 6 shows, in side sectional view, assembled container assembly 10 showing tray 14 and filler insert 12 fitted into and within cover 18. Tray 14 rests upon filler base section 36 of filler insert 12 and filler flap forming sections 40 extend upwardly within cover 18. Articles 16 sit within tray recesses 42 in tray 14.

The method of assembly of container assembly 10 shown in FIG. 6 is indicated in FIG. 1. The final assembly step, not shown, is for the assembler to invert container assembly 10 with its contents and fasten cover 18 to filler base section 36 of filler insert 12 with any conventional fastening means, preferably taping means.

For such inversion to be successfully accomplished, articles 16 and the height of cover 18 must be coordinated so as to minimize open head space within assembled container assembly 10.

Other modifications of the container assembly of the present invention will become apparent to those skilled in the art from an examination of the above patent Specification and drawings. Therefore, other variations of the present invention may be made which fall within the scope of the following claims even though such variations were not specifically discussed above.

Industrial Applicability

The simplified container assembly of the present invention can be used for the shipment and storage of products of many kinds. The only limitations are that the products must fit securely and closely against the top of the cover of the container so that inversion is possible without product damage.

However, this relative size limitation presents one of the major advantages of the container assembly: it becomes an extremely compact and space efficient container. It is more compact than a standard shipper carton, thereby allowing more cartons to be loaded per pallet.

The other major advantages of the present invention are the minimization of material usage and simplicity and efficiency of assembly.

The advantages noted above, size, economy and efficiency, all combine to produce a shipping and storage container that (using the display/storage trays as well as the cover and filler insert) has proved to produce a significant savings when utilized in a production line for the packaging of an array of products.

What I claim:

1. A method of assembling a separable two-part container assembly adapted for the shipment and storage of articles comprising:

providing a corrugated filler insert forming blank and a corrugated cover blank, the corrugated filler insert forming blank having a substantially rectangular base section, defined by two edge margins in opposed spaced-apart relation, and two edge fold lines in opposed spaced-apart relation, the filler insert forming blank further having, along two of the edge margins a pair of spaced-apart end flaps unitary with the base but each end flap being separated therefrom by the corresponding edge fold-line, the corrugated cover forming blank having an essentially rectangular shape having a bottom margin, a top margin, and first and second end margins, the essentially rectangular shape having extending across the width of the blank along one axis thereof, four sidewall fold lines, the four sidewall fold lines thus defining four essentially rectangular sidewall portions, each sidewall portion having located along the top margin of the corrugated cover forming blank and integrally formed therewith but separated therefrom by a cover top fold line, four cover top flap portions, each top flap extending above a corresponding sidewall portion, the corrugated cover forming blank further having a cover attachment flap located along and coextensive with the first end margin of the corrugated cover forming blank, the attachment flap being integrally formed with the corrugated cover forming blank but separated therefrom by an attachment flap fold line, taking the filler insert forming blank and folding each filler insert flap upwardly along the corresponding filler insert flap fold line, taking the corrugated cover forming blank and folding the cover forming blank along each of the four sidewall fold lines and along the attachment flap fold line, so that the attachment flap located along the first end margin of the corrugated cover blank is brought into the proximity of the second end margin of the corrugated cover blank, fastening, by adhesive means, the attachment flap to the second end margin of the cover blank, forming the corrugated cover forming blank into the configuration of an essentially rectangular box open at its top and bottom ends, taking the container cover and folding inwardly and downwardly, along each top cover flap fold line, first one oppositely located pair of cover top flaps and then a second, oppositely located pair of cover top flaps, to form a top section for the cover formed from the cover forming blank, fastening the second, upper pair of top cover flaps to each other with taping means to secure the top section of the cover, placing the articles to be shipped and stored onto the base section of the filler insert and between the filler flaps of the filler insert, fitting the now assembled cover over the filler insert and the articles situated upon the filler insert in such a way that the filler insert flaps extend upwardly within the cover, and the ends of the cover sidewalls are co-extensive with the corresponding filler edge margins and filler edge fold lines, the assembled cover and filler insert container which now has the overall form of a solid essentially rectangular object, inverting the assembled cover and filler insert container assembly, and fastening with taping means the exposed base section of the filler insert to two or more sidewalls of the cover, thus forming and securing the fully enclosed essentially rectangular two-part container assembly.

2. A method of assembly a separable two-part container assembly adapted for the shipment and storage of articles comprising:

providing a corrugated filler insert forming blank and a corrugated cover blank, the corrugated filler insert forming blank having a substantially rectangular base section, defined by two edge margins in opposed spaced-apart relation, and two edge fold lines in opposed spaced-apart relation, the filler insert forming blank further having, along two of the edge margins a pair of spaced-apart end flaps unitary with the base but each end flap being separated therefrom by the corresponding edge fold-line, the corrugated cover forming blank having an essentially rectangular shape having a bottom, a top, and first and second end margins, the essentially rectangular shape having extending across the width of the blank along one axis thereof, four sidewall fold lines, the four sidewall fold lines thus defining four essentially rectangular sidewall portions, each sidewall portion having located along the top margin of the corrugated cover forming blank and integrally formed therewith but separated therefrom by a cover top fold line, from cover top flap portions one top flap extending above each sidewall portion, the corrugated cover forming blank further having a cover attachment flap located along and coextensive with the first end margin of the corrugated cover forming blank, the attachment flap being integrally formed with the corrugated cover forming blank but separated therefrom by an attachment flap fold line, taking the filler insert forming blank and folding each filler insert flap upwardly along the corresponding filler insert flap fold line, taking the corrugated cover forming blank and folding the cover forming blank along each of the four sidewall fold lines, so that the attachment flap located along the first end margin of the corrugated cover blank is brought into the proximity of a second end margin of the corrugated cover blank, fastening, by adhesive means, the attachment flap to and over the second end margin of the cover blank, forming the corrugated cover forming blank into the configuration of an essentially rectangular box open at its top and bottom ends, taking the container cover and folding, along each top cover flap fold line, inwardly and downwardly first one oppositely located pair of cover top flaps and then a second, oppositely located pair of cover top flaps to form a top section for the cover formed from the cover forming blank, fastening the second, upper pair of top cover flaps to each other with taping means to secure the top section of the cover, providing a tray adapted to accept and hold the articles to be shipped in stored in the container assembly, placing tray on the base section of the filler insert and positioning it between the filler flaps of the filler insert, placing the articles t be shipped and stored onto the base section of the filler insert and between the filler flaps of the filler insert, fitting the now assembled cover over the filler insert and the articles situated upon the filler insert in such a way that the filler insert flaps extend upwardly within the cover, and the ends of the cover sidewalls are co-extensive with the corresponding filler edge margins and filler edge fold lines, the assembled cover and filler insert container which now has the overall form of a solid essentially rectangular object, inverting the assembled cover and filler insert container assembly, and fastening with taping means the exposed base section of the filler insert to two or more sidewalls of the cover, thus forming and securing the fully enclosed essentially rectangular two-part container assembly.

* * * * *